US009991598B2

(12) United States Patent
Kaechi

(10) Patent No.: US 9,991,598 B2
(45) Date of Patent: Jun. 5, 2018

(54) WIRELESS COMMUNICATION DEVICE AND ELECTRONIC APPARATUS

(71) Applicant: CANON KABUSHIKI KAISHA, Tokyo (JP)

(72) Inventor: Shuya Kaechi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 308 days.

(21) Appl. No.: 14/574,863

(22) Filed: Dec. 18, 2014

(65) Prior Publication Data

US 2015/0188229 A1 Jul. 2, 2015

(30) Foreign Application Priority Data

Dec. 27, 2013 (JP) ..... 2013-273493

(51) Int. Cl.
*H01Q 1/24* (2006.01)
*H01Q 7/06* (2006.01)
(Continued)

(52) U.S. Cl.
CPC ..... *H01Q 7/06* (2013.01); *H01Q 1/243* (2013.01); *H01Q 1/38* (2013.01); *H01Q 5/314* (2015.01); *H01Q 1/2225* (2013.01)

(58) Field of Classification Search
CPC ..... G06K 19/0723; G06K 19/0725; G06K 19/025; G06K 19/027; G06K 19/045; G06K 19/145; G06K 19/07773; G06K 7/0095; G06K 7/0029; G06K 7/10099; G06K 7/10108; G06K 7/10138; G06K 7/10188; G06K 7/10237; G06K 7/10297;
(Continued)

(56) References Cited

U.S. PATENT DOCUMENTS 7,102,520 B2 * 9/2006 Liu ..... G06K 19/07749 340/572.1
7,212,124 B2 5/2007 Ohkawa et al.
(Continued)

FOREIGN PATENT DOCUMENTS

CN 1639911 A 7/2005
EP 1439487 A2 7/2004
(Continued)

OTHER PUBLICATIONS

Korean Office Action dated Apr. 20, 2016 in Korean Application No. 10-2014-0191763.
(Continued)

*Primary Examiner* — Hoang Nguyen
*Assistant Examiner* — Awat Salih
(74) *Attorney, Agent, or Firm* — Fitzpatrick, Cella, Harper & Scinto

(57) ABSTRACT

A wireless communication device includes an antenna unit including an antenna pattern; a magnetic member arranged over the antenna unit; and a device that acts as a non-contact type integrated circuit, wherein a ratio of an area of the magnetic member to an area of a region including an outermost periphery of the antenna pattern is 90% or more, and wherein a resonant frequency of the wireless communication device has a deviation from a target resonant frequency falls within a range of −1.720% to +4.334%.

19 Claims, 12 Drawing Sheets

(51) Int. Cl.
*H01Q 1/38* (2006.01)
*H01Q 5/314* (2015.01)
*H01Q 1/22* (2006.01)

(58) Field of Classification Search
CPC ..... G06K 7/10386; G06K 7/10445; G06K 7/1097; G06K 7/10247; H01Q 1/242; H01Q 1/38; H01Q 1/48; H01Q 1/243; H01Q 1/2208; H01Q 1/2216; H01Q 1/2225; H01Q 7/00; H01Q 7/06
USPC ..... 343/702, 788; 340/572.1
IPC ..... G06K 19/07; H01Q 7/07
See application file for complete search history.

(56) References Cited

U.S. PATENT DOCUMENTS 7,495,625 B2 2/2009 Endo et al.
7,840,206 B2 11/2010 Kaechi
8,611,958 B2 * 12/2013 Koyama ..... H01Q 1/243 343/702
8,792,837 B2 * 7/2014 Deguchi ..... G06K 7/10336 343/788
9,077,067 B2 * 7/2015 Ikemoto ..... H01Q 5/35
9,246,214 B2 * 1/2016 Pope ..... H01Q 1/243
2002/0183022 A1 * 12/2002 Nikawa ..... G06K 19/0726 455/121
2004/0140896 A1 7/2004 Ohkawa et al.
2004/0183743 A1 * 9/2004 Reasoner ..... G06K 7/10336 343/895
2005/0092836 A1 * 5/2005 Kudo ..... G06K 7/10316 235/436
2005/0162331 A1 7/2005 Endo et al.
2006/0202831 A1 * 9/2006 Horch ..... G06K 7/0095 340/572.7
2007/0001921 A1 * 1/2007 Takahashi ..... H01Q 1/38 343/788
2007/0095913 A1 * 5/2007 Takahashi ..... G06K 7/10336 235/451
2007/0216534 A1 * 9/2007 Ferguson ..... G06K 19/07745 340/572.7
2009/0146790 A1 * 6/2009 Speich ..... B65H 35/04 340/10.1
2009/0231139 A1 * 9/2009 Heurtier ..... G06K 19/0724 340/572.7
2009/0278690 A1 * 11/2009 Degani ..... G06K 19/07749 340/572.7
2010/0109968 A1 * 5/2010 Suzuki ..... H01Q 1/2216 343/876
2010/0190528 A1 * 7/2010 Hsiao ..... G06K 19/041 455/558
2010/0258639 A1 * 10/2010 Florek ..... G06K 19/07732 235/492
2010/0283698 A1 * 11/2010 Orihara ..... G06K 19/07749 343/788
2011/0132988 A1 * 6/2011 Watanabe ..... G06K 19/0723 235/492
2012/0091821 A1 * 4/2012 Kato ..... H01Q 1/38 307/104
2012/0112971 A1 * 5/2012 Takeyama ..... H01Q 7/04 343/702
2012/0178365 A1 * 7/2012 Katz ..... G06K 7/10237 455/41.1
2012/0326931 A1 * 12/2012 Murayama ..... G06K 19/07749 343/702
2013/0002502 A1 * 1/2013 Wang ..... H01Q 1/2208 343/793
2013/0059534 A1 * 3/2013 Sobalvarro ..... G06Q 30/02 455/41.1
2013/0062875 A1 * 3/2013 Le Loarer ..... G06K 19/025 283/83
2014/0176382 A1 * 6/2014 Nakano ..... H01Q 1/243 343/788
2014/0184461 A1 * 7/2014 Kim ..... H01Q 7/06 343/788
2014/0292611 A1 * 10/2014 Kubo ..... G06K 7/10336 343/867

FOREIGN PATENT DOCUMENTS

EP 001523158 * 9/2004
EP 002581984 * 9/2012
FR 002962579 * 7/2010
JP 2001382637 * 12/2001
JP 2003-188765 A 7/2003
JP 2004-227046 8/2004
JP 2005-070855 A1 3/2005
JP 2005-327245 A 11/2005
JP U3123411 6/2006
JP 2007-012689 A 1/2007
JP 2007-243468 A 9/2007
JP 2015-070405 4/2015
KR 10-2007-0040907 A 4/2007
KR 10-2009-0003795 A 1/2009

OTHER PUBLICATIONS

UK Office Action dated Jun. 9, 2015 for counterpart UK Patent Application No. GB1422811.8.
German Office Action dated Jun. 9, 2015 for counterpart German Patent Application No. 1422811.8.
Chinese Office Action dated Apr. 1, 2017 in Chinese Application No. 201410832011.6.

* cited by examiner

FIG. 11

| TOLERANCE RANGE OF RESONANT FREQUENCY | RESONANT FREQUENCY [MHz] | DEVIATION D1 FROM TARGET RESONANT FREQUENCY (13.56 MHz) [%] |
|---|---|---|
| MINIMUM VALUE | 13.00 | −4.130 |
| CENTRAL VALUE | 13.56 | 0.000 |
| MAXIMUM VALUE | 14.50 | +6.932 |

FIG. 12

| CAPACITANCE TOLERANCE OF EXTERNAL CAPACITOR | RESONANT FREQUENCY [MHz] | DEVIATION D2 FROM TARGET RESONANT FREQUENCY (13.56 MHz) [%] |
|---|---|---|
| MINIMUM VALUE: −5% | 13.23 | −2.410 |
| CENTRAL VALUE: ±0% | 13.56 | 0.0000 |
| MAXIMUM VALUE: +5% | 13.91 | +2.598 |

FIG. 13

| | INDUCTANCE VALUE L OF ANTENNA PATTERN [$\mu$H] | MAGNETIC SHEET TYPE |
|---|---|---|
| FIG. 6A | 1.02 | MAGNETIC SHEET A |
| FIG. 6B | 1.52 | MAGNETIC SHEET A |
| FIG. 6C | 1.02 | MAGNETIC SHEET B |
| FIG. 6D | 1.52 | MAGNETIC SHEET B |

FIG. 14

| | TOLERANCE RANGE OF RESONANT FREQUENCY BASED ON COMMUNICATION DISTANCE [MHz] | TOLERANCE RANGE OF OF RESONANT FREQUENCY IN CONSIDERATION OF CAPACITANCE TOLERANCE OF EXTERNAL CAPACITOR [MHz] | ALLOWANCE VALUE OF DEVIATION D3 (DEVIATION D1 – DEVIATION D2) [%] |
|---|---|---|---|
| MINIMUM VALUE | 13.00 | 13.23 | −1.720 |
| CENTRAL VALUE | 13.56 | 13.56 | 0.0000 |
| MAXIMUM VALUE | 14.50 | 13.91 | +4.334 |

WIRELESS COMMUNICATION DEVICE AND ELECTRONIC APPARATUS

BACKGROUND

Field of the Invention

The present invention relates to a non-contact type IC (integrated circuit) device including a non-contact type IC (integrated circuit), a wireless communication device, and an electronic apparatus including the wireless communication device.

Description of the Related Art

A wireless communication device such as a non-contact type IC (integrated circuit) card includes a non-contact type IC (integrated circuit). Japanese Patent Application Laid-Open No. 2003-188765 describes a method of adjusting a resonant frequency of a RFID tag that is a kind of non-contact type IC device.

When a non-contact type IC device including an antenna unit and a non-contact type IC is set in an electronic apparatus (such as a camera), a resonant frequency of the non-contact type IC device may be deviated by a metal material contained in the electronic apparatus. Such a problem can be reduced by using a magnetic member such as a magnetic sheet. This is because the magnetic member can reduce an influence of the metal material on the resonant frequency of the non-contact type IC device, which is an advantage.

However, the magnetic member causes a deviation between the resonant frequency of the non-contact type IC device and a target resonant frequency, which is a disadvantage. Hence, in a case of using the magnetic member, it is desirable to appropriately control a balance between the advantage that the magnetic member can reduce an influence of the metal material on the resonant frequency of the non-contact type IC device, and the disadvantage that the magnetic member causes a deviation between the resonant frequency of the non-contact type IC device and the target resonant frequency.

SUMMARY

According to an aspect of the present invention, at least one of a wireless communication device, and a non-contact type integrated circuit device, and an electronic apparatus is provided.

According to another aspect of the present invention, a deviation between a resonant frequency of a non-contact type IC device and a target resonant frequency can be suppressed in a case where an antenna unit and a magnetic member (magnetic sheet and the like) are used.

According to another aspect of the present invention, there is provided a wireless communication device including an antenna unit including an antenna pattern; a magnetic member arranged over the antenna unit; and a device that acts as a non-contact type integrated circuit, wherein a ratio of an area of the magnetic member to an area of a region including an outermost periphery of the antenna pattern is 90% or more, and wherein a resonant frequency of the wireless communication device has a deviation from a target resonant frequency falls within a range of −1.720% to +4.334%.

According to another aspect of the present invention, there is provided an electronic apparatus including a wireless communication device. The wireless communication device includes an antenna unit including an antenna pattern; a magnetic member arranged over the antenna unit; and a device that acts as a non-contact type integrated circuit, wherein a ratio of an area of the magnetic member to an area of a region including an outermost periphery of the antenna pattern is 90% or more, and wherein a resonant frequency of the wireless communication device has a deviation from a target resonant frequency falls within a range of −1.720% to +4.334%.

Further features and aspects of the present invention will become apparent from the following description of exemplary embodiments.

BRIEF DESCRIPTION OF THE DRAWINGS

FIG. 11 is a diagram for describing an example of a relationship between a tolerance range of a resonant frequency of the non-contact type IC device 100 and a range of a deviation D1 from the target resonant frequency (13.56 MHz).

FIG. 12 is a diagram for describing an example of a range of a deviation D2 of a resonant frequency in a case where a capacitance tolerance of an external capacitor is ±5%.

FIG. 13 is a diagram for describing an example of a relationship between an inductance value of an antenna pattern (conductive pattern) included in the antenna unit 101 and a magnetic sheet type used for measurement.

FIG. 14 is a diagram for describing an example of a range of an allowance value of the deviation D3 from the target resonant frequency (13.56 MHz).

DESCRIPTION OF THE EMBODIMENTS

Exemplary embodiments of the present invention will be described below with reference to the drawings. Exemplary embodiments of the present invention are not limited to the following exemplary embodiments.

First Exemplary Embodiment

Figure 1A:
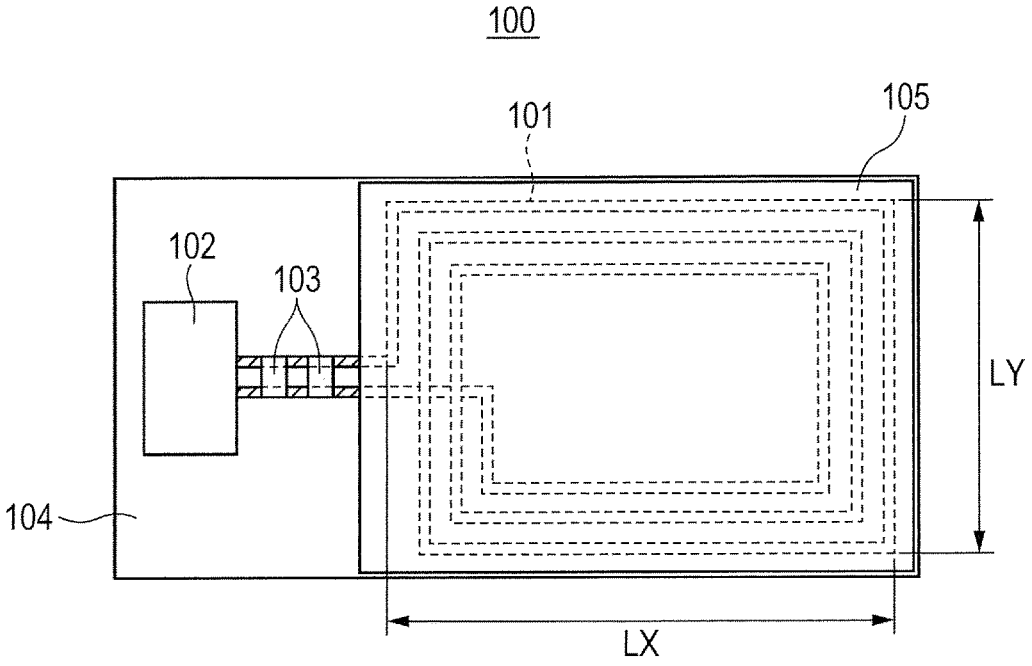
FIGS. 1A and 1B are diagrams for describing a first example of a non-contact type IC device 100 according to a first exemplary embodiment.
Figure 1B:
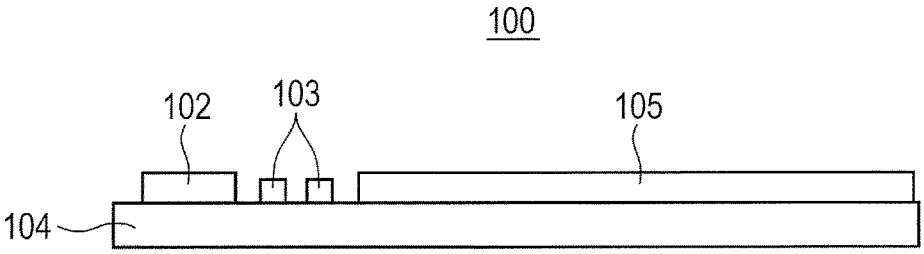

FIGS. 1A and 1B are diagrams for describing a first example of a non-contact type IC (integrated circuit) device 100 according to a first exemplary embodiment. FIG. 1A illustrates a top view of the non-contact type IC device 100. FIG. 1B illustrates a cross-sectional view of the non-contact type IC device 100.

The non-contact type IC device 100 is, for example, a wireless communication device that controls wireless communications with frequencies within a high frequency (HF) range. The non-contact type IC device 100 is, for example, a wireless communication device that controls wireless communications based on a near field communication (NFC) standard.

The non-contact type IC device 100 illustrated in FIGS. 1A and 1B includes an antenna unit 101, a non-contact type IC (integrated circuit) 102, a capacitor 103, a substrate 104, and a magnetic sheet 105. In the first exemplary embodiment, the magnetic sheet 105, the antenna unit 101, and the substrate 104 are stacked on each other. For example, in the first exemplary embodiment, the antenna unit 101 is arranged on the substrate 104, and the magnetic sheet 105 is arranged on the substrate 104 and the antenna unit 101. In other words, in the first exemplary embodiment, the antenna unit 101 is arranged between the substrate 104 and the magnetic sheet 105.

The antenna unit 101 includes, for example, an antenna pattern that is a conductive pattern having a spiral structure with turns.

The non-contact type IC 102 is a device that acts as a non-contact type IC (integrated circuit). The non-contact type IC 102 is connected to the antenna unit 101 via two antenna terminals. The non-contact type IC 102 acts, for example, as a device for controlling wireless communications with frequencies within a high frequency (HF) range. The non-contact type IC device 100 acts, for example, as a device for controlling wireless communications based on a near field communication (NFC) standard.

The capacitor 103 is an external capacitor for adjusting a resonant frequency of the non-contact type IC device 100. Note that, although the capacitor 103 includes two capacitors in the first exemplary embodiment, the capacitor 103 may include one capacitor and may include three or more capacitors.

The substrate 104 is a substrate on which the antenna unit 101, the non-contact type IC 102, the capacitor 103, and the magnetic sheet 105 are arranged. The substrate 104 may be any of a rigid substrate and a flexible substrate.

The magnetic sheet 105 is a magnetic member for reducing an influence of a metal material existing near the non-contact type IC device 100. The magnetic sheet 105 is arranged on the substrate 104 and the antenna unit 101. The magnetic sheet 105 may be attached to the substrate 104 using double-sided tape. Alternatively, the magnetic sheet 105 may be held on the substrate 104 using another component.

In the first exemplary embodiment, a shape including the outermost periphery of the antenna pattern included in the antenna unit 101 is defined as "antenna region". In the first exemplary embodiment, the antenna region has a rectangular shape. The length of the antenna region of the antenna unit 101 is defined as "LX", and the width of the antenna region of the antenna unit 101 is defined as "LY". The area of the antenna region of the antenna unit 101 is calculated according to LX×LY.

As illustrated in FIGS. 6A to 9F, the non-contact type IC device 100 is set in an electronic apparatus 200. The electronic apparatus 200 is, for example, an apparatus that acts as an image capture apparatus. The electronic apparatus 200 is, for example, any of a camera, a video camera, a mobile phone including a camera, and an electronic apparatus including a camera.

Next, an example of a measurement result of a communication distance between the non-contact type IC device 100 of the first exemplary embodiment and a non-contact type IC (integrated circuit) reader/writer is described with reference to FIGS. 2A and 2B.

The inventor of the present application configured the non-contact type IC device 100 as illustrated in FIGS. 1A and 1B, and measured a communication distance between the non-contact type IC device 100 and a non-contact type IC (integrated circuit) reader/writer.

Figure 2A:
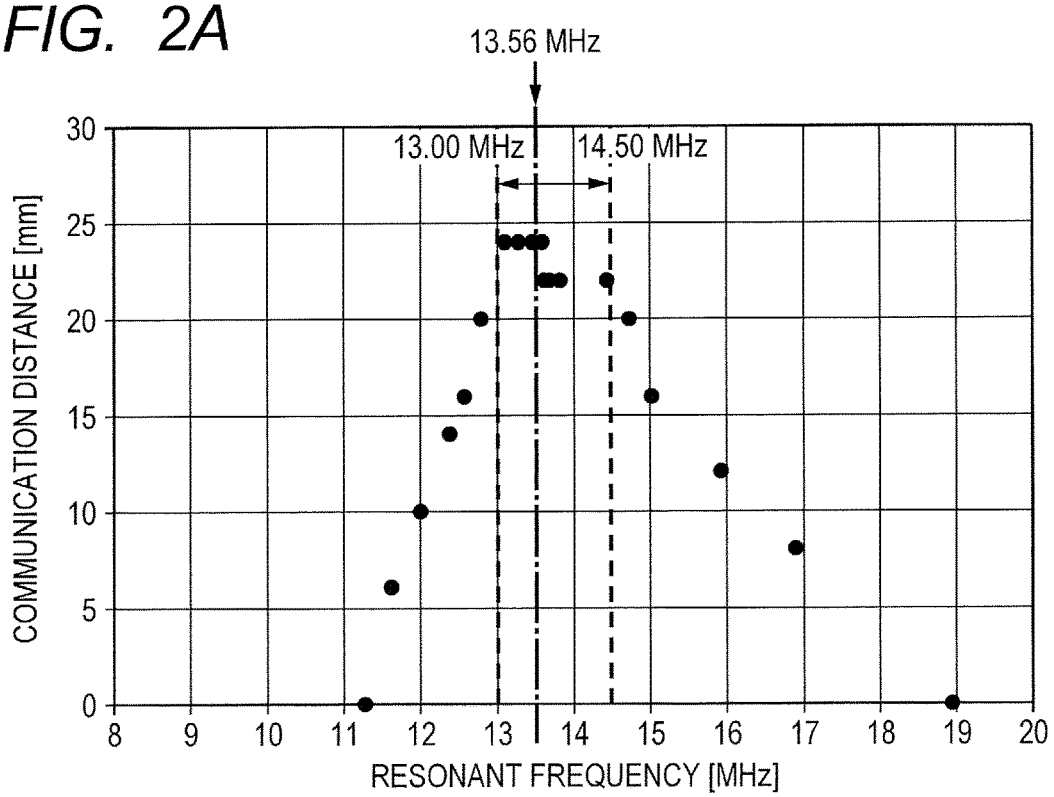
FIGS. 2A and 2B are graphs for describing an example of a measurement result of a communication distance between the non-contact type IC device 100 illustrated in FIGS. 1A and 1B and a non-contact type IC reader/writer.
Figure 2B:
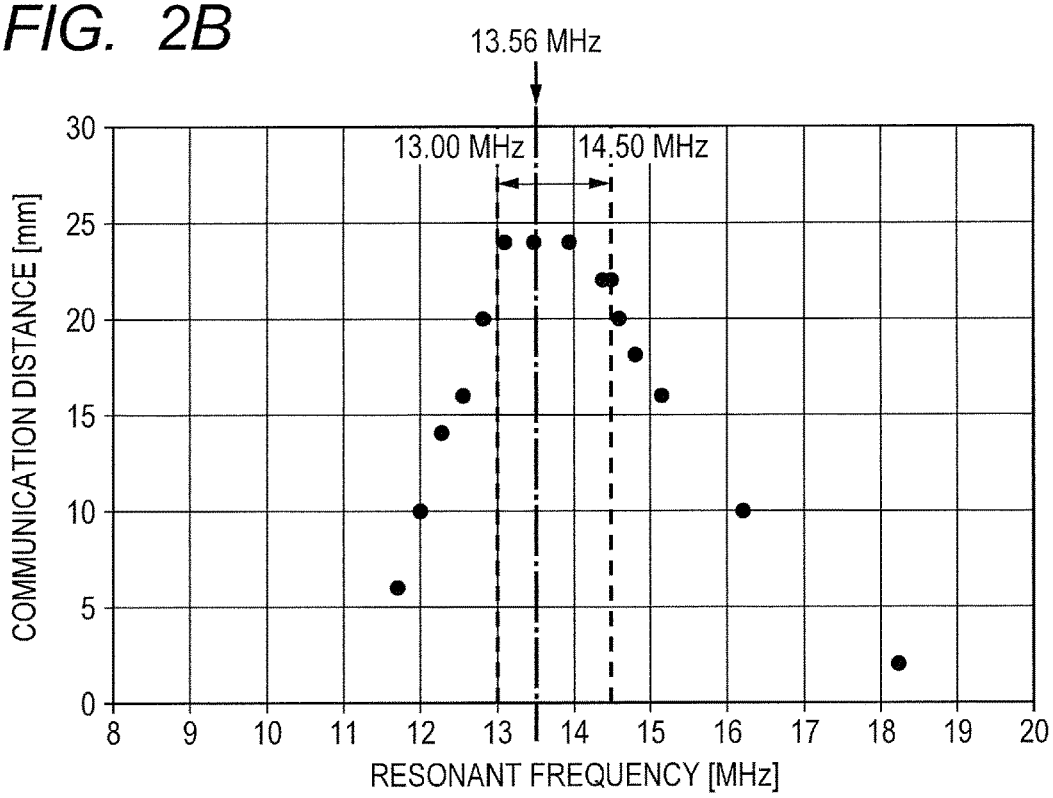

In FIGS. 2A and 2B, the horizontal axis represents a resonant frequency [MHz] of the non-contact type IC device 100. The vertical axis represents a communication distance [mm] between the non-contact type IC device 100 and the non-contact type IC reader/writer. Here, the communication distance [mm] represents a distance between an outer case of the non-contact type IC device 100 and an outer case of the non-contact type IC reader/writer. Hereinafter, a resonant frequency of the non-contact type IC device 100 is simply referred to as a resonant frequency.

FIG. 2A illustrates an example of a measurement result in a case where a magnetic sheet A is used as the magnetic sheet 105. A magnetic permeability W of the magnetic sheet A is about 120.

FIG. 2B illustrates an example of a measurement result in a case where a magnetic sheet B is used as the magnetic sheet 105. A magnetic permeability W of the magnetic sheet B is about 30.

Note that JIS X 6319-4 (a specification/standard for integrated circuit cards—regulated by JICSAP (Japan IC Card System Application Council)) was used for communications between the non-contact type IC device 100 and the non-contact type IC reader/writer. The carrier frequency of the non-contact type IC reader/writer was 13.56 MHz. The antenna resonant frequency of the non-contact type IC reader/writer was 13.01 MHz.

It is understood from FIGS. 2A and 2B that a communication distance in a case where the resonant frequency is around 13.56 MHz, which is the carrier frequency of the non-contact type IC reader/writer, is longest. The maximum value of the communication distance in a case where the resonant frequency is around 13.56 MHz was 24 mm. It is also understood from FIGS. 2A and 2B that, if the resonant frequency is deviated from 13.56 MHz, the communication distance is decreased.

The condition under which a decrease from the maximum value (24 mm) of the communication distance is less than 10% is referred to as a condition C1. It is understood that a resonant frequency range that satisfies the condition C1 is about 13.00 MHz to 14.50 MHz. Hereinafter, the resonant frequency range that satisfies the condition C1 is referred to as a tolerance range (or tolerable range) of the resonant frequency.

An example of a relationship between the tolerance range of the resonant frequency of the non-contact type IC device 100 and a range of a deviation D1 from a target resonant frequency (13.56 MHz) is illustrated in FIG. 11. It is desirable to configure the non-contact type IC device 100 such that, for example, the range of the deviation D1 from the target resonant frequency (13.56 MHz) falls within the range of −4.130% to +6.932%.

Figure 3:
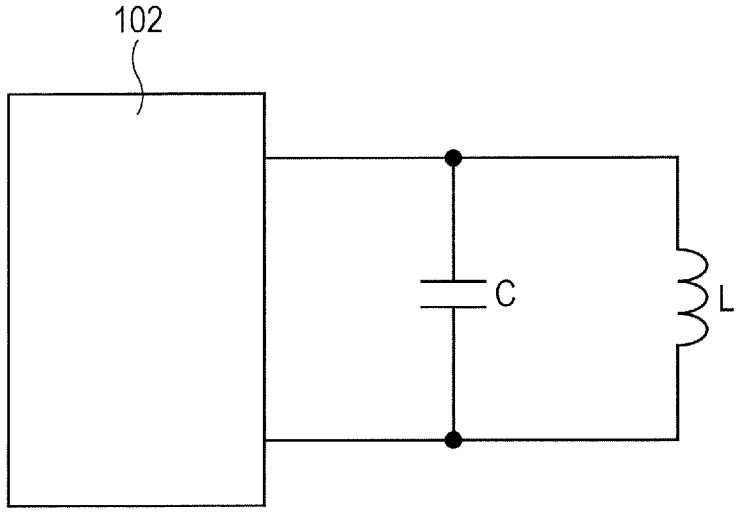
FIG. 3 is a diagram for describing an equivalent circuit of the non-contact type IC device 100 illustrated in FIGS. 1A and 1B.

Next, an equivalent circuit of the non-contact type IC device 100 is described with reference to FIG. 3.

The equivalent circuit of the non-contact type IC device 100 can be regarded as an LC resonant circuit. In FIG. 3, a value of an inductance L is determined depending on influences of the structure of the non-contact type IC device 100 and components incorporated in the non-contact type IC device 100. In particular, an inductance of the antenna unit 101 is dominant in the value of the inductance L.

Similarly to the value of the inductance L, a value of a capacitance C is also determined depending on influences of the structure of the non-contact type IC device 100 and the components incorporated in the non-contact type IC device 100. The value of the capacitance C can be adjusted by using one or more external capacitors. Accordingly, the resonant frequency can be adjusted to a desired resonant frequency by using one or more external capacitors.

A resonant frequency f0 of the LC resonant circuit that is the equivalent circuit of the non-contact type IC device 100 can be calculated using Expression (1). In Expression (1), the value of the inductance L is represented by L, and the value of the capacitance C is represented by C.

$$f0=1/(2\pi(LC)^{1/2}) \qquad \text{Expression (1)}$$

In order to design the non-contact type IC device 100 such that the resonant frequency f0 is equal to the target resonant frequency (13.56 MHz), for example, a capacitance value of the capacitor 103 may be adjusted. In the first exemplary embodiment, for example, the capacitor 103, which is an external capacitor for adjusting the resonant frequency, has a capacitance tolerance (or capacitance tolerable difference) of ±5%.

In the first exemplary embodiment, for example, a temperature characteristic of the capacitor 103 is 0±60 ppm. In the first exemplary embodiment, it is assumed that a change in capacitance depending on a temperature coefficient is ignored. In a case where the capacitance tolerance of the capacitor 103 is ±5%, a range of a deviation D2 from the target resonant frequency (13.56 MHz) is, for example, as illustrated in FIG. 12.

In a case as illustrated in FIG. 12 where the capacitance tolerance of the capacitor 103 is ±5%, the range of the deviation D2 from the target resonant frequency (13.56 MHz) is −2.410% to +2.598%. The range (−2.410% to +2.598%) of the deviation D2 illustrated in FIG. falls within the range (−4.130% to +6.932%) of the deviation D1 illustrated in FIG. 11. Accordingly, if the non-contact type IC device 100 is configured such that, for example, the capacitance tolerance of the capacitor 103 is ±5%, no problem occurs.

In a case of configuring the non-contact type IC device 100, the antenna unit 101 and the magnetic sheet 105 are stacked on each other. Hence, it is necessary to consider a risk that the resonant frequency is further deviated by a deviation between the antenna unit 101 and the magnetic sheet 105 when both are stacked.

Next, the deviation between the antenna unit 101 and the magnetic sheet 105 when both are stacked is described with reference to FIGS. 4A to 4F.

Figure 4A:
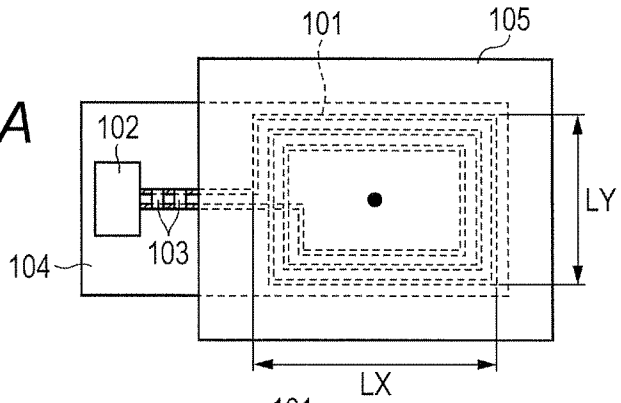
FIGS. 4A, 4B, 4C, 4D, 4E, and 4F are diagrams for describing a deviation between an antenna unit 101 and a magnetic sheet 105 when both are stacked.
Figure 4B:
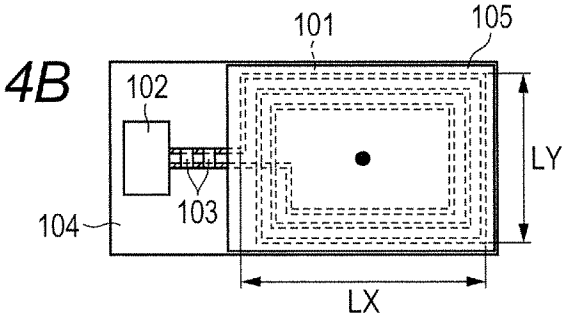

FIGS. 4A and 4B each illustrate an example of a state where the antenna unit 101 and the magnetic sheet 105 are stacked on each other such that a deviation between a central point of the antenna unit 101 and a central point of the magnetic sheet 105 is zero.

In FIG. 4A, an area Sb of the magnetic sheet 105 is sufficiently larger than an area Sa of the antenna region (LX×LY). Hence, it is considered that, even if the antenna unit 101 and the magnetic sheet 105 are deviated to some degree, the magnetic sheet 105 can sufficiently cover the antenna unit 101. In the configuration illustrated in FIG. 4A, it is not necessary to strictly control the deviation between the antenna unit 101 and the magnetic sheet 105 when both are stacked. However, the costs of the magnetic sheet 105 are high, and hence, it is desirable to minimize the area Sb of the magnetic sheet 105.

In FIGS. 4B to 4F, the area Sb of the magnetic sheet 105 is larger than the area Sa of the antenna region (LX×LY), but is not sufficiently larger than the area Sa thereof. In this case, it is desirable to consider an influence that is exerted on the resonant frequency by the deviation between the antenna unit 101 and the magnetic sheet 105 when both are stacked.

Figure 4C:
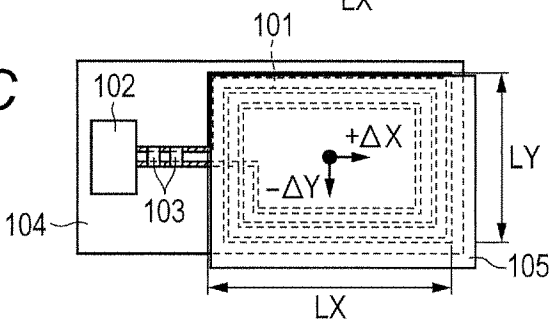
Figure 4D:
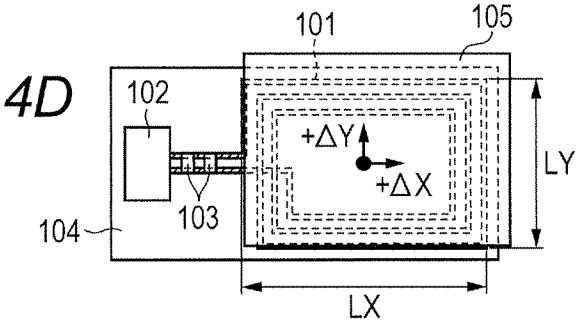
Figure 4E:
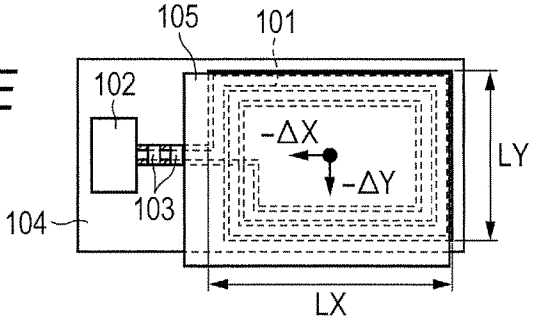
Figure 4F:
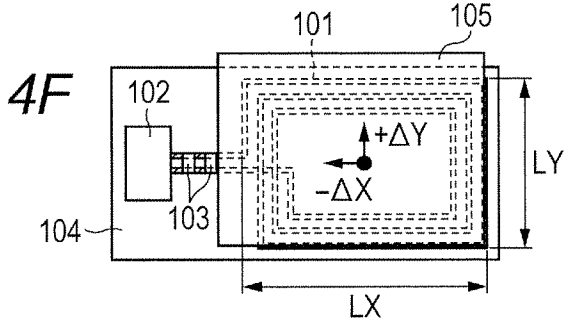

FIGS. 4C to 4F each illustrate a case where the central point of the magnetic sheet 105 is deviated from the central point of the antenna unit 101. FIG. 4C illustrates a case where the central point of the magnetic sheet 105 is deviated by +ΔX in an X direction and by −ΔY in a Y direction. FIG. 4D illustrates a case where the central point of the magnetic sheet 105 is deviated by +ΔX in the X direction and by +ΔY in the Y direction. FIG. 4E illustrates a case where the central point of the magnetic sheet 105 is deviated by −ΔX in the X direction and by −ΔY in the Y direction. FIG. 4F illustrates a case where the central point of the magnetic sheet 105 is deviated by −ΔX in the X direction and by +ΔY in the Y direction.

A deviation of the resonant frequency at which the antenna unit 101 and the magnetic sheet 105 are stacked as illustrated in each of FIGS. 4C to 4F is expected to be larger than a deviation of the resonant frequency at which the antenna unit 101 and the magnetic sheet 105 are stacked as illustrated in FIG. 4B. In view of this, the inventor of the present application measured a relationship between an area cover ratio (Sb/Sa) [%] and a deviation D3 [%] from the target resonant frequency (13.56 MHz). The measurement results are illustrated in FIGS. 5A to 5D. Note that, in the first exemplary embodiment, the resonant frequency at which the state where the deviation between the central point of the antenna unit 101 and the central point of the magnetic sheet 105 is zero was adjusted to the target resonant frequency (13.56 MHz), and the deviation D3 [%] from the target resonant frequency was then measured.

In FIGS. 5A to 5D, the horizontal axis represents the area cover ratio (Sb/Sa) [%]. The vertical axis represents the deviation D3 [%] from the target resonant frequency (13.56 MHz).

Here, the area cover ratio (Sb/Sa) [%] refers to a ratio (Sb/Sa) of the area Sb of the magnetic sheet 105 to the area Sa of the antenna region (LX×LY) of the antenna unit 101. In a case where the area Sb of the magnetic sheet 105 and the area Sa of the antenna region (LX×LY) are coincident with each other, the area cover ratio (Sb/Sa) [%] is 100%. In a case where the area Sb of the magnetic sheet 105 is larger than the area Sa of the antenna region (LX×LY), the area cover ratio (Sb/Sa) [%] is higher than 100%. In a case where the area Sb of the magnetic sheet 105 is smaller than the area Sa of the antenna region (LX×LY), the area cover ratio (Sb/Sa) [%] is lower than 100%.

Figure 5A:
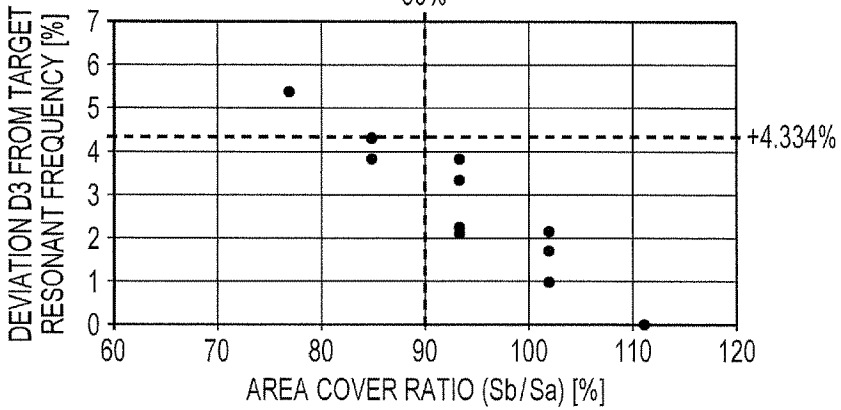
FIGS. 5A, 5B, 5C, and 5D are graphs for describing an example of a relationship between an area cover ratio (Sb/Sa) [%] and a deviation D3 [%] from a target resonant frequency (13.56 MHz).

The graph of FIG. 5A illustrates the measurement result in a case where the magnetic sheet 105 is deviated in a direction (lower right direction) illustrated in FIG. 4C.

Figure 5B:
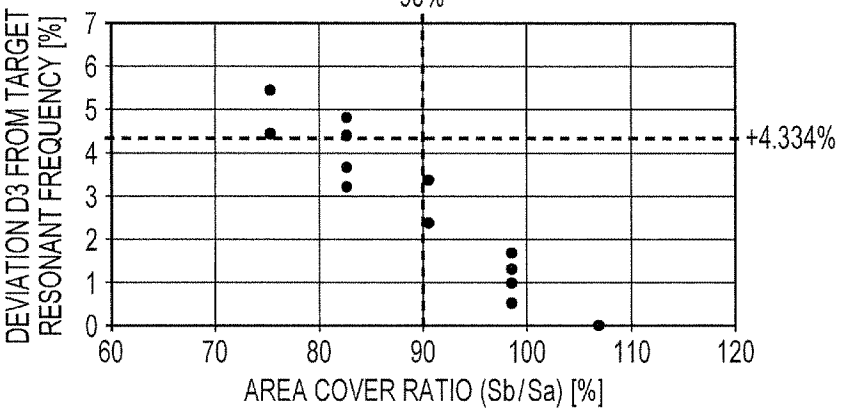

The graph of FIG. 5B illustrates the measurement result in a case where the magnetic sheet 105 is deviated in a direction (upper right direction) illustrated in FIG. 4D.

Figure 5C:
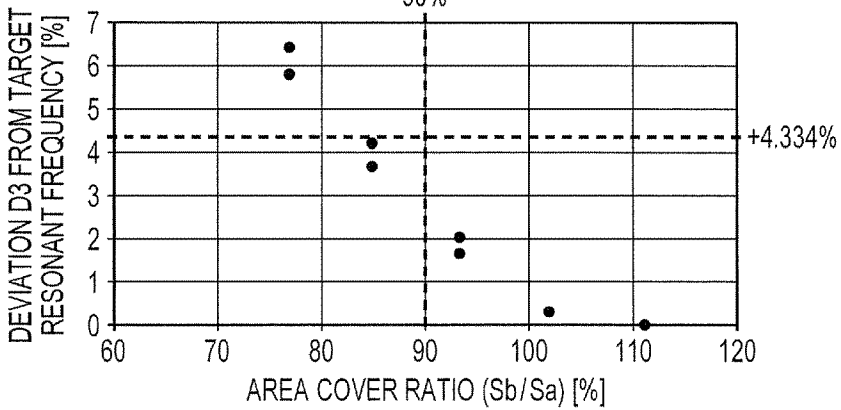

The graph of FIG. 5C illustrates the measurement result in a case where the magnetic sheet 105 is deviated in a direction (lower left direction) illustrated in FIG. 4E.

Figure 5D:
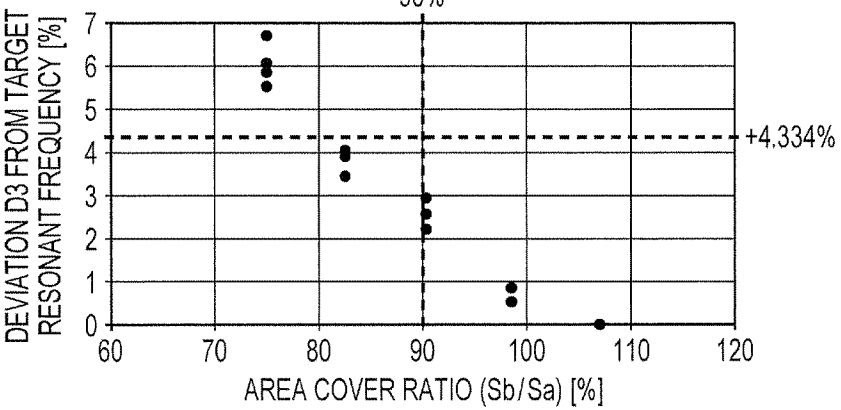

The graph of FIG. 5D illustrates the measurement result in a case where the magnetic sheet 105 is deviated in a direction (upper left direction) illustrated in FIG. 4F.

An example of a relationship between an inductance value of the antenna pattern included in the antenna unit 101 and a magnetic sheet type used for the measurement is as illustrated in FIG. 13.

The graph of FIG. 5A illustrates the measurement result in a case where the inductance value of the antenna pattern included in the antenna unit 101 is 1.02 μH and where the magnetic sheet A is used as the magnetic sheet 105.

The graph of FIG. 5B illustrates the measurement result in a case where the inductance value of the antenna pattern included in the antenna unit 101 is 1.52 μH and where the magnetic sheet A is used as the magnetic sheet 105.

The graph of FIG. 5C illustrates the measurement result in a case where the inductance value of the antenna pattern included in the antenna unit 101 is 1.02 μH and where the magnetic sheet B is used as the magnetic sheet 105.

The graph of FIG. 5D illustrates the measurement result in a case where the inductance value of the antenna pattern included in the antenna unit 101 is 1.52 μH and where the magnetic sheet B is used as the magnetic sheet 105.

As understood from the graphs of FIGS. 5A to 5D, as the area cover ratio (Sb/Sa) [%] becomes lower, the deviation D3 [%] from the target resonant frequency (13.56 MHz) becomes larger. In other words, as the area cover ratio (Sb/Sa) [%] becomes lower, the target resonant frequency (13.56 MHz) shifts in a high frequency direction.

As described above, it is desirable to configure the non-contact type IC device 100 such that the range of the deviation D1 from the target resonant frequency (13.56 MHz) falls within the range of −4.130% to +6.932%. In view of this, an allowance value of the deviation D3 from the target resonant frequency (13.56 MHz) is calculated based on the deviation D1 (see FIG. 11) and the deviation D2 (see FIG. 12), and the calculation results are, for example, as illustrated in FIG. 14. The allowance value of the deviation D3 from the target resonant frequency (13.56 MHz) is calculated by subtracting the deviation D2 from the deviation D1.

As illustrated in FIG. 14, the range of the allowance value of the deviation D3 from the target resonant frequency (13.56 MHz) is, for example, −1.720% to +4.334%. Accordingly, in a case of changing the area cover ratio (Sb/Sa) [%], it is desirable to configure the non-contact type IC device 100 such that the deviation D3 from the target resonant frequency (13.56 MHz) falls within the range of −1.720% to +4.334%.

Based on the calculation results illustrated in FIG. 14 and the measurement results illustrated in FIGS. 5A to 5D, the area cover ratio (Sb/Sa) [%] is determined such that the deviation D3 from the target resonant frequency (13.56 MHz) falls within the range of −1.720% to +4.334%. As a result, it is understood that it is desirable to set the area cover ratio (Sb/Sa) [%] to be 90% or more.

As describe above, in a case where the non-contact type IC device 100 is incorporated in the electronic apparatus 200, it is desirable to determine an arrangement of the antenna unit 101 and the magnetic sheet 105 such that the area cover ratio (Sb/Sa) [%] is 90% or more. For example, even if the antenna unit 101 and the magnetic sheet 105 are deviated from each other by moving the electronic apparatus 200, it is desirable to determine the arrangement of the antenna unit 101 and the magnetic sheet 105 such that the area cover ratio (Sb/Sa) [%] is not lower than 90%.

If the antenna unit 101 and the magnetic sheet 105 are arranged as described above, even in a case where the antenna unit 101 and the magnetic sheet 105 are deviated from each other, a deviation between the resonant frequency of the non-contact type IC device 100 and the target resonant frequency can be suppressed, and a decrease in communication distance can be suppressed.

Note that the antenna pattern included in the antenna unit 101 may have any shape as long as a selected shape enables the area cover ratio (Sb/Sa) [%] to be 90% or more. For example, the antenna pattern included in the antenna unit 101 may have a circular shape. Alternatively, the antenna pattern included in the antenna unit 101 may have a shape in which part of it is different from another part.

Next, a first example and a second example of the electronic apparatus 200 in which the non-contact type IC device 100 is set are described with reference to FIGS. 6A to 6F.

Figure 6A:
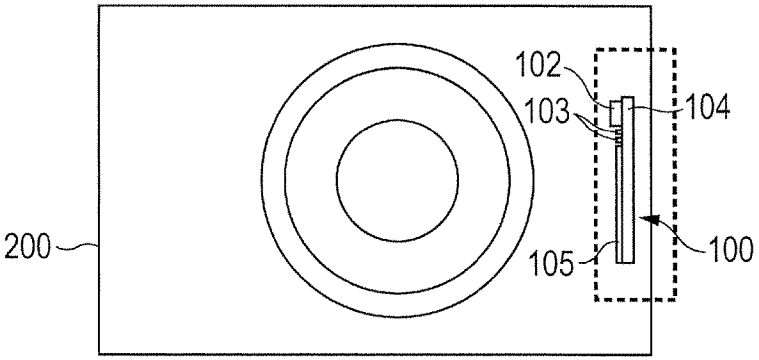
FIGS. 6A, 6B, 6C, 6D, 6E, and 6F are diagrams for describing a first example and a second example of an electronic apparatus 200 in which the non-contact type IC device 100 is incorporated.
Figure 6B:
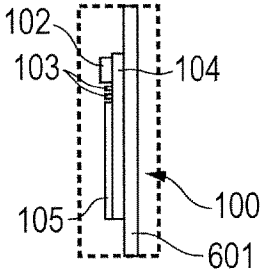
Figure 6C:
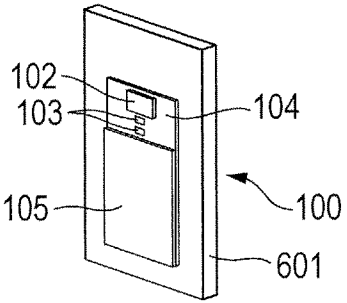

FIGS. 6A to 6C are diagrams for describing the first example of the electronic apparatus 200 in which the non-contact type IC device 100 is set.

FIG. 6A illustrates an example of a front view of the electronic apparatus 200. As illustrated in FIG. 6A, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 6B illustrates an example of the portion in which the non-contact type IC device 100 is set. A dotted line in FIG. 6B corresponds to the dotted line in FIG. 6A.

FIG. 6C illustrates a perspective view of the portion in which the non-contact type IC device 100 is set, which is observed from the left. In FIGS. 6B and 6C, a member 601 is an outer casing member of the electronic apparatus 200, and the member 601 includes a planar portion in the inner direction of the electronic apparatus 200. The non-contact type IC device 100 is, for example, attached to the planar portion of the member 601. The member 601 may be made of, for example, resin.

In FIGS. 6A to 6C, the antenna unit 101 and the magnetic sheet 105 are arranged such that the area cover ratio (Sb/Sa) [%] is 90% or more. If the antenna unit 101 and the magnetic sheet 105 are arranged such that the area cover ratio (Sb/Sa) [%] is 90% or more, a deviation between the resonant frequency of the non-contact type IC device 100 and the target resonant frequency can be suppressed, and a decrease in communication distance can be suppressed.

Figure 6D:
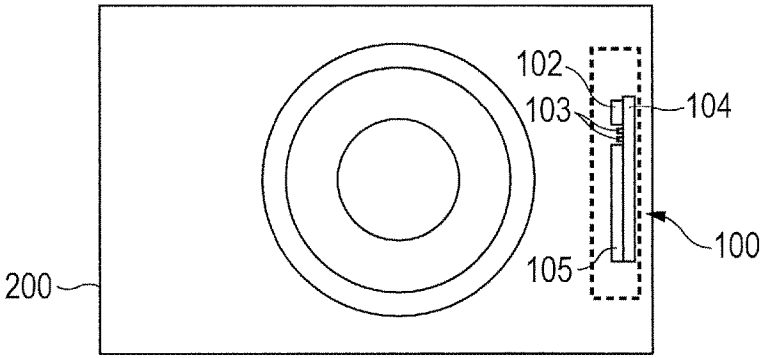
Figure 6E:
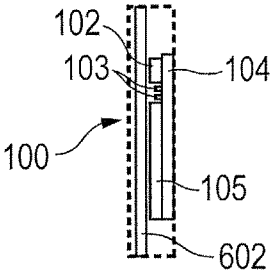
Figure 6F:
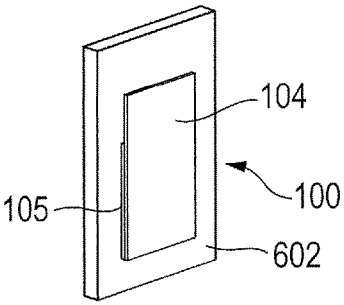

FIGS. 6D to 6F are diagrams for describing the second example of the electronic apparatus 200 in which the non-contact type IC device 100 is set.

FIG. 6D illustrates an example of a front view of the electronic apparatus 200. As illustrated in FIG. 6D, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 6E illustrates an example of the portion in which the non-contact type IC device 100 is set. A dotted line in FIG. 6E corresponds to the dotted line in FIG. 6D. FIG. 6F illustrates a perspective view of the portion in which the non-contact type IC device 100 is set, which is observed from the right. In FIGS. 6E and 6F, a member 602 is a holding member set inside of the electronic apparatus 200, and the member 602 includes a planar portion in the outer direction of the electronic apparatus 200.

The non-contact type IC device 100 is, for example, attached to the planar portion of the member 602. The member 602 may be made of, for example, one of resin and metal. The member 602 may be, for example, a frame that supports the structure of the electronic apparatus 200.

In FIGS. 6D to 6F, the antenna unit 101 and the magnetic sheet 105 are arranged such that the area cover ratio (Sb/Sa) [%] is 90% or more. If the antenna unit 101 and the magnetic sheet 105 are arranged such that the area cover ratio (Sb/Sa) [%] is 90% or more, a deviation between the resonant frequency of the non-contact type IC device 100 and the target resonant frequency can be suppressed, and a decrease in communication distance can be suppressed.

Next, a third example and a fourth example of the electronic apparatus 200 in which the non-contact type IC device 100 is set are described with reference to FIGS. 7A to 7F.

Figure 7A:
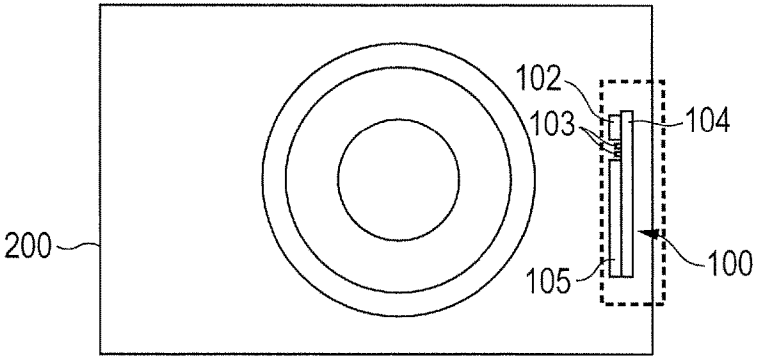
FIGS. 7A, 7B, 7C, 7D, 7E, and 7F are diagrams for describing a third example and a fourth example of the electronic apparatus 200 in which the non-contact type IC device 100 is incorporated.
Figure 7B:
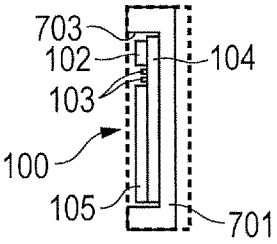
Figure 7C:
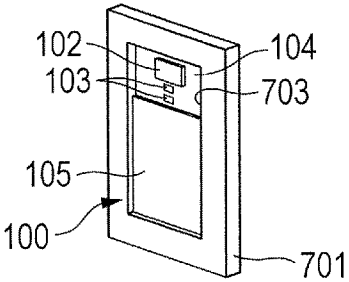

FIGS. 7A to 7C are diagrams for describing the third example of the electronic apparatus 200 in which the non-contact type IC device 100 is set.

FIG. 7A illustrates an example of a front view of the electronic apparatus 200. As illustrated in FIG. 7A, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 7B illustrates an example of the portion in which the non-contact type IC device 100 is set. A dotted line in FIG. 7B corresponds to the dotted line in FIG. 7A.

FIG. 7C illustrates a perspective view of the portion in which the non-contact type IC device 100 is set, which is observed from the left.

In FIGS. 7B and 7C, a member 701 is an outer casing member of the electronic apparatus 200, and the member 701 includes a concave portion 703 in the inner direction of the electronic apparatus 200. The non-contact type IC device 100 is, for example, attached so as to be housed in the concave portion 703 included in the member 701. The member 701 may be made of, for example, resin.

In FIGS. 7A to 7C, a relative position between the antenna unit 101 and the magnetic sheet 105 is restricted by means of the shape of the concave portion 703 included in the member 701. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Although it is possible to restrict the relative position between the antenna unit 101 and the magnetic sheet 105 by means of the shape of the concave portion 703 included in the member 701 such that the area cover ratio (Sb/Sa) [%] is 90% or more, the first exemplary embodiment is not limited thereto. For example, the relative position between the antenna unit 101 and the magnetic sheet 105 may be restricted by means of the shape of the concave portion 703 included in the member 701 and one of the capacitor 103, the non-contact type IC 102, and another component such that the area cover ratio (Sb/Sa) [%] is 90% or more.

Note that the length in the depth direction of the concave portion 703 included in the member 701 can be, for example, equal to or more than the largest value of the height of the non-contact type IC device 100. The depth of the concave portion 703 included in the member 701 can be, for example, equal to or more than a total value of the thickness of the substrate 104, the thickness of the antenna unit 101, and the thickness of the magnetic sheet 105.

Figure 7D:
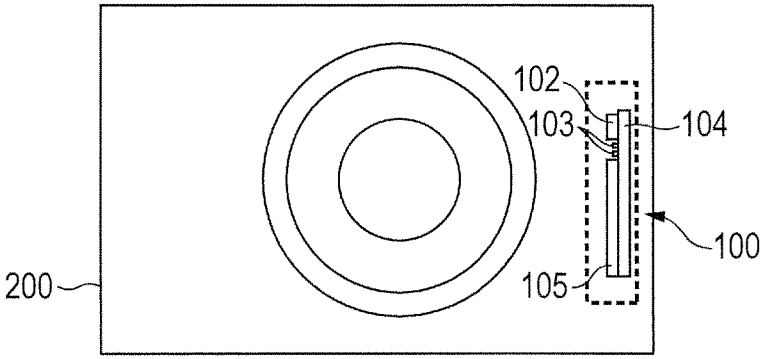
Figure 7E:
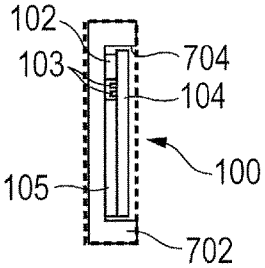
Figure 7F:
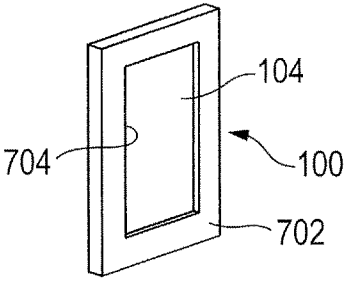

FIGS. 7D to 7F are diagrams for describing the fourth example of the electronic apparatus 200 in which the non-contact type IC device 100 is set.

FIG. 7D illustrates an example of a front view of the electronic apparatus 200. As illustrated in FIG. 7D, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 7E illustrates an example of the portion in which the non-contact type IC device 100 is set. A dotted line in FIG. 7E corresponds to the dotted line in FIG. 7D.

FIG. 7F illustrates a perspective view of the portion in which the non-contact type IC device 100 is set, which is observed from the right.

In FIGS. 7E and 7F, a member 702 is a holding member set inside of the electronic apparatus 200, and the member 702 includes a concave portion 704 in the outer direction of the electronic apparatus 200. The non-contact type IC device 100 is, for example, attached so as to be housed in the concave portion 704 included in the member 702. The member 702 may be made of, for example, one of resin and metal. The member 702 may be, for example, a frame that supports the structure of the electronic apparatus 200.

In FIGS. 7D to 7F, a relative position between the antenna unit 101 and the magnetic sheet 105 is restricted by means of the shape of the concave portion 704 included in the member 702. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Although it is possible to restrict the relative position between the antenna unit 101 and the magnetic sheet 105 by means of the shape of the concave portion 704 included in the member 702 such that the area cover ratio (Sb/Sa) [%] is 90% or more, the first exemplary embodiment is not limited thereto. For example, the relative position between the antenna unit 101 and the magnetic sheet 105 may be restricted by means of the shape of the concave portion 704 included in the member 702 and one of the capacitor 103, the non-contact type IC 102, and another component such that the area cover ratio (Sb/Sa) [%] is 90% or more.

Note that the length in the depth direction of the concave portion 704 included in the member 702 can be, for example, equal to or more than the largest value of the height of the non-contact type IC device 100. The depth of the concave portion 704 included in the member 702 can be, for example, equal to or more than a total value of the thickness of the substrate 104, the thickness of the antenna unit 101, and the thickness of the magnetic sheet 105.

Next, a fifth example and a sixth example of the electronic apparatus 200 in which the non-contact type IC device 100 is set are described with reference to FIGS. 8A to 8F.

Figure 8A:
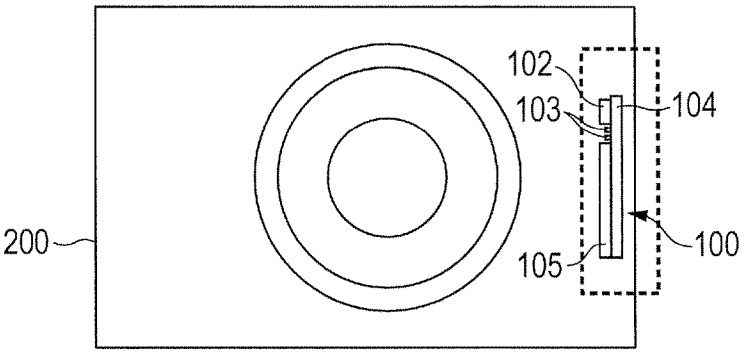
FIGS. 8A, 8B, 8C, 8D, 8E, and 8F are diagrams for describing a fifth example and a sixth example of the electronic apparatus 200 in which the non-contact type IC device 100 is incorporated.
Figure 8B:
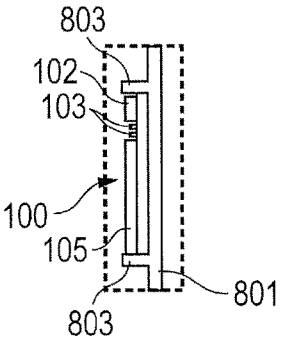
Figure 8C:
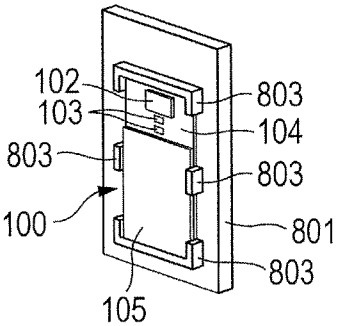

FIGS. 8A to 8C are diagrams for describing the fifth example of the electronic apparatus 200 in which the non-contact type IC device 100 is set.

FIG. 8A illustrates an example of a front view of the electronic apparatus 200. As illustrated in FIG. 8A, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 8B illustrates an example of the portion in which the non-contact type IC device 100 is set. A dotted line in FIG. 8B corresponds to the dotted line in FIG. 8A.

FIG. 8C illustrates a perspective view of the portion in which the non-contact type IC device 100 is set, which is observed from the left.

In FIGS. 8B and 8C, a member 801 is an outer casing member of the electronic apparatus 200, and the member 801 includes convex portions 803 in the inner direction of the electronic apparatus 200. The non-contact type IC device 100 is, for example, attached to the convex portions 803 included in the member 801. The member 801 may be made of, for example, resin.

In FIGS. 8A to 8C, a relative position between the antenna unit 101 and the magnetic sheet 105 is restricted by means of the shapes of the convex portions 803 included in the member 801. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Although it is possible to restrict the relative position between the antenna unit 101 and the magnetic sheet 105 by means of the shapes of the convex portions 803 included in the member 801 such that the area cover ratio (Sb/Sa) [%] is 90% or more, the first exemplary embodiment is not limited thereto. For example, the relative position between the antenna unit 101 and the magnetic sheet 105 may be restricted by means of the shapes of the convex portions 803 included in the member 801 and one of the capacitor 103, the non-contact type IC 102, and another component such that the area cover ratio (Sb/Sa) [%] is 90% or more.

Note that the length in the height direction of the convex portions 803 included in the member 801 can be, for example, equal to or more than the largest value of the height of the non-contact type IC device 100. The height of the convex portions 803 included in the member 801 can be, for example, equal to or more than a total value of the thickness of the substrate 104, the thickness of the antenna unit 101, and the thickness of the magnetic sheet 105.

Figure 8D:
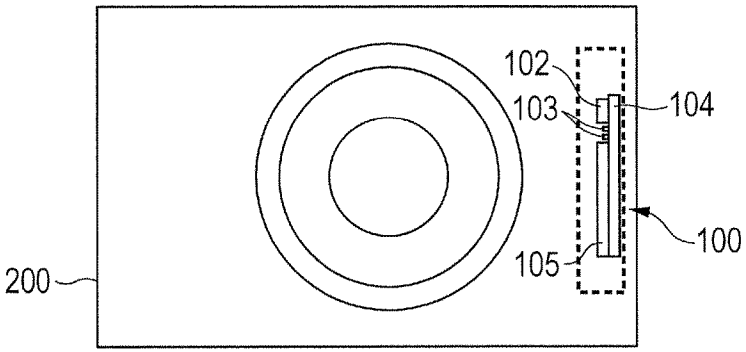
Figure 8E:
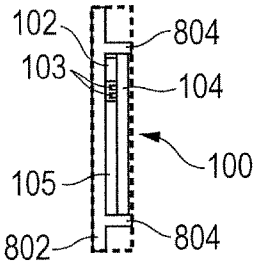
Figure 8F:
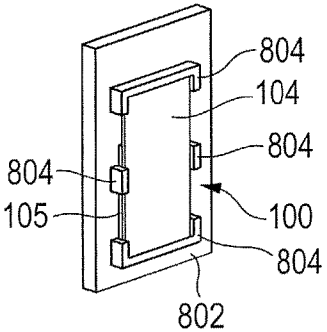

FIGS. 8D to 8F are diagrams for describing the sixth example of the electronic apparatus 200 in which the non-contact type IC device 100 is set.

FIG. 8D illustrates an example of a front view of the electronic apparatus 200. As illustrated in FIG. 8D, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 8E illustrates an example of the portion in which the non-contact type IC device 100 is set. A dotted line in FIG. 8E corresponds to the dotted line in FIG. 8D.

FIG. 8F illustrates a perspective view of the portion in which the non-contact type IC device 100 is set, which is observed from the right.

In FIGS. 8E and 8F, a member 802 is a holding member set inside of the electronic apparatus 200, and the member 802 includes convex portions 804 in the outer direction of the electronic apparatus 200. The non-contact type IC device 100 is, for example, attached to the convex portions 804 included in the member 802. The member 802 may be made of, for example, one of resin and metal. The member 802 may be, for example, a frame that supports the structure of the electronic apparatus 200.

In FIGS. 8D to 8F, a relative position between the antenna unit 101 and the magnetic sheet 105 is restricted by means of the shapes of the convex portions 804 included in the member 802. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Although it is possible to restrict the relative position between the antenna unit 101 and the magnetic sheet 105 by means of the shapes of the convex portions 804 included in the member 802 such that the area cover ratio (Sb/Sa) [%] is 90% or more, the first exemplary embodiment is not limited thereto. For example, the relative position between the antenna unit 101 and the magnetic sheet 105 may be restricted by means of the shapes of the convex portions 804 included in the member 802 and one of the capacitor 103, the non-contact type IC 102, and another component such that the area cover ratio (Sb/Sa) [%] is 90% or more.

Note that the length in the height direction of the convex portions 804 included in the member 802 can be, for example, equal to or more than the largest value of the height of the non-contact type IC device 100. The height of the convex portions 804 included in the member 802 can be, for example, equal to or more than a total value of the thickness of the substrate 104, the thickness of the antenna unit 101, and the thickness of the magnetic sheet 105.

Next, a seventh example and an eighth example of the electronic apparatus 200 in which the non-contact type IC device 100 is set are described with reference to FIGS. 9A to 9F.

Figure 9A:
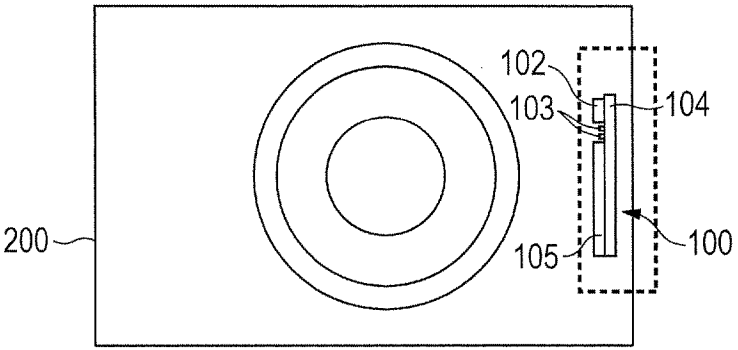
FIGS. 9A, 9B, 9C, 9D, 9E, and 9F are diagrams for describing a seventh example and an eighth example of the electronic apparatus 200 in which the non-contact type IC device 100 is incorporated.
Figure 9B:
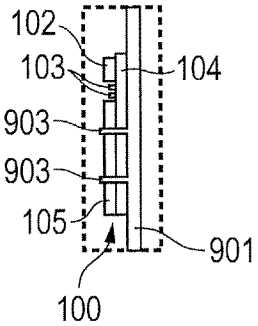
Figure 9C:
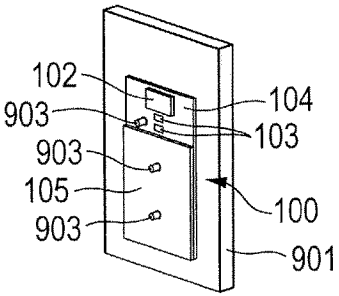

FIGS. 9A to 9C are diagrams for describing the seventh example of the electronic apparatus 200 in which the non-contact type IC device 100 is set.

FIG. 9A illustrates an example of a front view of the electronic apparatus 200. As illustrated in FIG. 9A, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 9B illustrates an example of the portion in which the non-contact type IC device 100 is set, and illustrates a cross-sectional view of the non-contact type IC device 100. A dotted line in FIG. 9B corresponds to the dotted line in FIG. 9A.

FIG. 9C illustrates a perspective view of the portion in which the non-contact type IC device 100 is set, which is observed from the left.

In FIGS. 9B and 9C, a member 901 is an outer casing member of the electronic apparatus 200, and the member 901 includes one or more convex members 903 in the inner direction of the electronic apparatus 200. The substrate 104 includes, for example, openings to be respectively fitted to the one or more convex members 903 included in the member 901. Similarly, the magnetic sheet 105 includes, for example, openings to be respectively fitted to the one or more convex members 903 included in the member 901. The openings included in the substrate 104 can be formed in portions that do not influence the antenna pattern and the like. The member 901 may be made of, for example, resin.

In FIGS. 9A to 9C, a relative position between the antenna unit 101 and the magnetic sheet 105 is restricted by means of the one or more convex members 903 included in the member 901. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Note that the height of one or more convex members 903 included in the member 901 can be, for example, equal to or more than the largest value of the height of the non-contact type IC device 100. The height of one or more convex members 903 included in the member 901 can be, for example, equal to or more than a total value of the thickness of the substrate 104, the thickness of the antenna unit 101, and the thickness of the magnetic sheet 105.

Figure 9D:
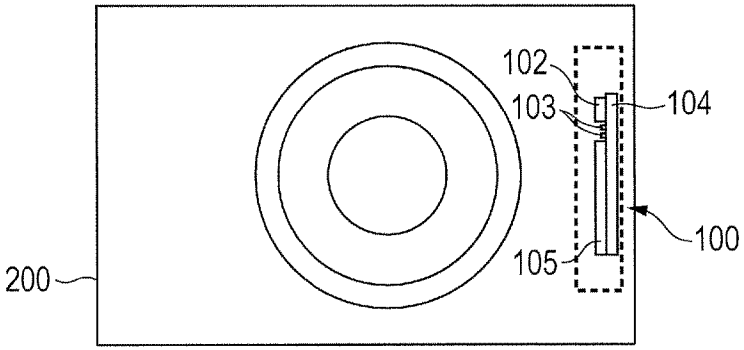
Figure 9E:
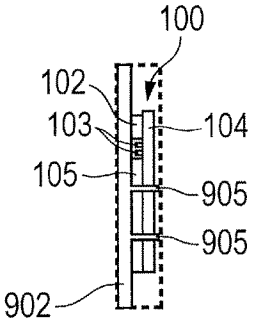
Figure 9F:
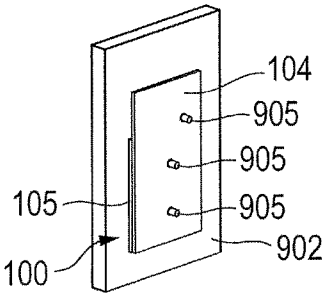

FIGS. 9D to 9F are diagrams for describing the eighth example of the electronic apparatus 200 in which the non-contact type IC device 100 is set.

FIG. 9D illustrates an example of a front view of the electronic apparatus 200. As illustrated in FIG. 9D, the non-contact type IC device 100 is, for example, incorporated in a portion surrounded by a dotted line. The non-contact type IC device 100 is, for example, incorporated so as to provide communication sensitivity to one side of the electronic apparatus 200.

FIG. 9E illustrates an example of the portion in which the non-contact type IC device 100 is set, and illustrates a cross-sectional view of the non-contact type IC device 100. A dotted line in FIG. 9E corresponds to the dotted line in FIG. 9D.

FIG. 9F illustrates a perspective view of the portion in which the non-contact type IC device 100 is set, which is observed from the right.

In FIGS. 9E and 9F, a member 902 is a holding member set inside of the electronic apparatus 200, and the member 902 includes one or more convex members 905 in the outer direction of the electronic apparatus 200. The substrate 104 includes, for example, openings to be respectively fitted to the one or more convex members 905 included in the member 902. Similarly, the magnetic sheet 105 includes, for example, openings to be respectively fitted to the one or more convex members 905 included in the member 902.

The openings included in the substrate 104 can be formed in portions that do not influence the antenna pattern and the like. The member 902 may be made of, for example, one of resin and metal. The member 902 may be, for example, a frame that supports the structure of the electronic apparatus 200.

In FIGS. 9D to 9F, a relative position between the antenna unit 101 and the magnetic sheet 105 is restricted by means of the one or more convex members 905 included in the member 902. If the relative position between the antenna unit 101 and the magnetic sheet 105 is restricted such that the area cover ratio (Sb/Sa) [%] is 90% or more, a deviation between the resonant frequency of the non-contact type IC device 100 and the target resonant frequency can be suppressed, and a decrease in communication distance can be suppressed.

Note that the height of one or more convex members 905 included in the member 902 can be, for example, equal to or more than the largest value of the height of the non-contact type IC device 100. The height of one or more convex members 905 included in the member 902 can be, for example, equal to or more than a total value of the thickness of the substrate 104, the thickness of the antenna unit 101, and the thickness of the magnetic sheet 105.

Next, a second example of the non-contact type IC device 100 according to the first exemplary embodiment is described with reference to FIGS. 10A and 10B.

In the first example of the non-contact type IC device 100 illustrated in FIGS. 1A and 1B, the non-contact type IC 102 and the antenna unit 101 are arranged on the same substrate 104. The configuration of the non-contact type IC device 100 is not limited to the configuration described in the first example. For example, the non-contact type IC device 100 can also be configured as illustrated in FIGS. 10A and 10B.

Figure 10A:
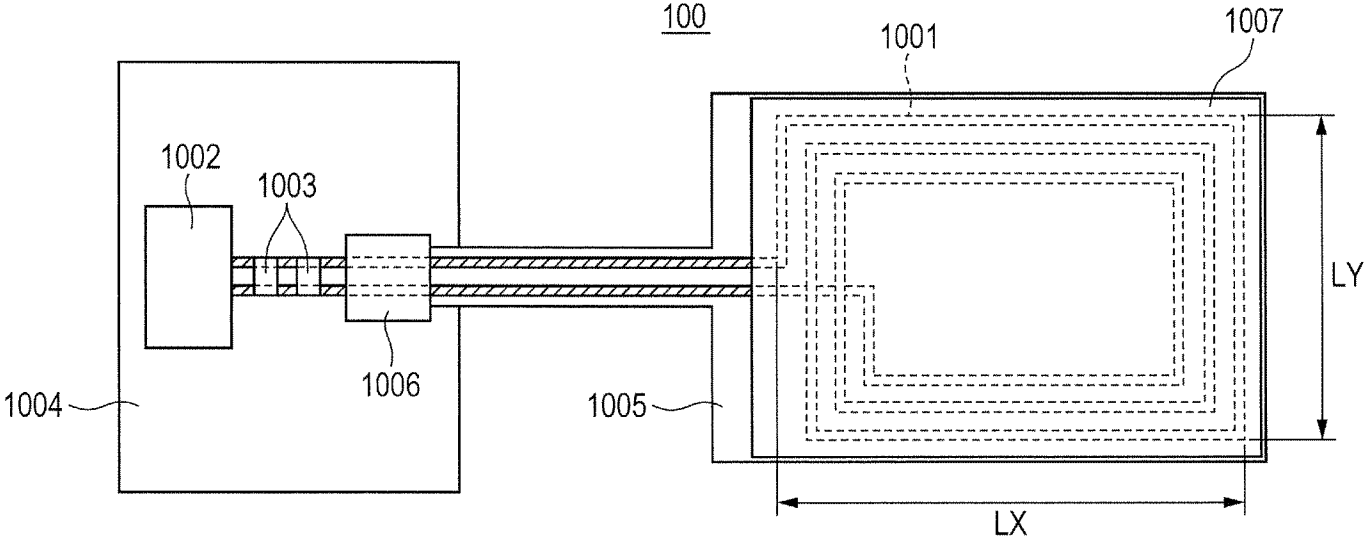
FIGS. 10A and 10B are diagrams for describing a second example of the non-contact type IC device 100 according to the first exemplary embodiment.

FIG. 10A illustrates a top view of the non-contact type IC device 100. FIG. 10B illustrates a cross-sectional view of the non-contact type IC device 100.

Figure 10B:
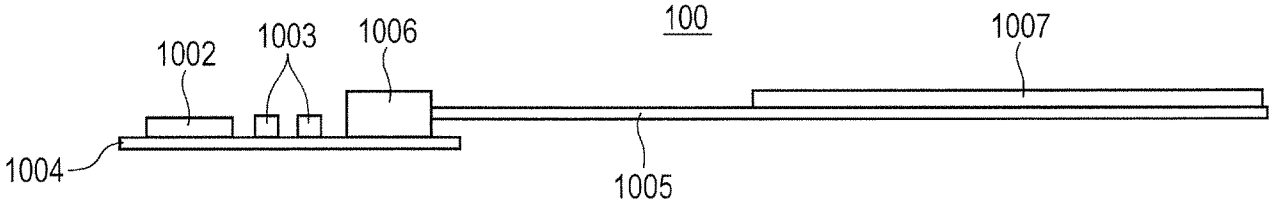

The non-contact type IC device 100 illustrated in FIGS. 10A and 10B includes an antenna unit 1001, a non-contact type IC 1002, a capacitor 1003, a first substrate 1004, a second substrate 1005, a connector 1006, and a magnetic sheet 1007.

In the first exemplary embodiment, the magnetic sheet 1007, the antenna unit 1001, and the second substrate 1005 are stacked on each other. For example, in the first exemplary embodiment, the antenna unit 1001 is arranged on the second substrate 1005, and the magnetic sheet 1007 is arranged on the second substrate 1005 and the antenna unit 1001. In other words, in the first exemplary embodiment, the antenna unit 1001 is arranged between the second substrate 1005 and the magnetic sheet 1007.

The antenna unit 1001 includes, for example, an antenna pattern having a spiral structure with turns, similarly to the antenna unit 101.

The non-contact type IC 1002 is a device that acts as a non-contact type integrated circuit (IC), similarly to the non-contact type IC 102. The non-contact type IC 1002 is connected to the antenna unit 1001 via two antenna terminals. The non-contact type IC 1002 acts, for example, as a device for controlling wireless communications with frequencies within a high frequency (HF) range. The non-contact type IC device 100 acts, for example, as a device for controlling wireless communications based on a near field communication (NFC) standard.

The capacitor 1003 is an external capacitor for adjusting the resonant frequency. Note that, although the capacitor 1003 includes two capacitors in the first exemplary embodiment, the capacitor 1003 may include one capacitor and may include three or more capacitors.

The first substrate 1004 is a substrate on which the non-contact type IC 1002, the capacitor 1003, and the connector 1006 are arranged. The first substrate 1004 may be any of a rigid substrate and a flexible substrate.

The second substrate 1005 is a substrate on which the antenna unit 1001 and the magnetic sheet 1007 are arranged. The second substrate 1005 may be any of a rigid substrate and a flexible substrate. The non-contact type IC 1002 on the first substrate 1004 and the antenna unit 1001 on the second substrate 1005 are connected to each other via the connector 1006.

The magnetic sheet 1007 is a magnetic member for reducing an influence of a metal material existing near the non-contact type IC device 100, similarly to the magnetic sheet 105. The magnetic sheet 1007 is arranged on the second substrate 1005 and the antenna unit 1001. The magnetic sheet 1007 may be attached to the second substrate 1005 using a double-sided tape. Alternatively, the magnetic sheet 1007 may be held on the second substrate 1005 using another component.

In the first exemplary embodiment, an antenna region of the antenna unit 1001 is defined similarly to the antenna region of the antenna unit 101. Accordingly, the length of the antenna region of the antenna unit 1001 is defined as "LX", and the width of the antenna region of the antenna unit 1001 is defined as "LY". The area of the antenna region of the antenna unit 1001 is calculated according to LX×LY.

Also in a case where the non-contact type IC device 100 is configured as illustrated in FIGS. 10A and 10B, it is desirable to determine an arrangement of the antenna unit 1001 and the magnetic sheet 1007 such that an area cover ratio (Sb/Sa) [%] is 90% or more. Here, the area cover ratio (Sb/Sa) [%] refers to a ratio (Sb/Sa) of the area Sb of the magnetic sheet 1007 to the area Sa of the antenna region (LX×LY) of the antenna unit 1001.

For example, even if the antenna unit 1001 and the magnetic sheet 1007 are deviated from each other by moving the electronic apparatus 200, it is desirable to determine the arrangement of the antenna unit 1001 and the magnetic sheet 1007 such that the area cover ratio (Sb/Sa) [%] is not lower than 90%. If the antenna unit 1001 and the magnetic sheet 1007 are arranged as described above, even in a case where the antenna unit 1001 and the magnetic sheet 1007 are deviated from each other, a deviation between the resonant frequency of the non-contact type IC device 100 and the target resonant frequency can be suppressed, and a decrease in communication distance can be suppressed.

Note that the antenna pattern included in the antenna unit 1001 may have any shape as long as a selected shape enables the area cover ratio (Sb/Sa) [%] to be 90% or more. For example, the antenna pattern included in the antenna unit 1001 may have a circular shape. Alternatively, the antenna pattern included in the antenna unit 1001 may have a shape in which part of it is different from another part.

The non-contact type IC device 100 illustrated in FIGS. 10A and 10B can also be set in the electronic apparatus 200, similarly to the non-contact type IC device 100 illustrated in FIGS. 1A and 1B (see FIGS. 6A to 9F). In a case where the non-contact type IC device 100 illustrated in FIGS. 10A and 10B is set in the electronic apparatus 200 as illustrated in FIGS. 9A to 9F, the second substrate 1005 includes, for example, openings to be respectively fitted to the one or more convex members 903 or 905 included in the member 901 or 902. In this case, similarly, the magnetic sheet 1007 includes, for example, openings to be respectively fitted to the one or more convex members 903 or 905 included in the member 901 or 902. The openings included in the second substrate 1005 can be formed in portions that do not influence the antenna pattern and the like.

As has been described hereinabove, in the first exemplary embodiment, in a case where the antenna unit 101 and the magnetic sheet 105 are used in combination, a deviation between the resonant frequency of the non-contact type IC device 100 and the target resonant frequency can be suppressed, and a decrease in communication distance can be suppressed. Moreover, in a case where the antenna unit 1001 and the magnetic sheet 1007 are used in combination, a deviation between the resonant frequency of the non-contact type IC device 100 and the target resonant frequency can be suppressed, and a decrease in communication distance can be suppressed.

Note that, although the target resonant frequency is 13.56 MHz in the first exemplary embodiment, the target resonant frequency may be changed to a predetermined resonant frequency other than 13.56 MHz. In a case where the target resonant frequency is changed to a predetermined resonant frequency other than 13.56 MHz, the deviations D1, D2, and D3 may be calculated with the target resonant frequency being changed to the predetermined resonant frequency, and the area cover ratio (Sb/Sa) [%] may be determined based on the calculated deviations D1, D2, and D3.

Second Exemplary Embodiment

Various functions, processes, and methods described in the first exemplary embodiment can be implemented by a personal computer, a microcomputer, a central processing unit (CPU), and the like using programs. Hereinafter, in a second exemplary embodiment, the personal computer, the microcomputer, the CPU, and the like are collectively referred to as a "computer X". Moreover, in the second exemplary embodiment, a program for controlling the computer X and for implementing the various functions, processes, and methods described in the first exemplary embodiment is referred to as a "program Y".

The various functions, processes, and methods described in the first exemplary embodiment are implemented by the computer X executing the program Y. In this case, the program Y is supplied to the computer X through a computer-readable storage medium. The computer-readable storage medium in the second exemplary embodiment includes at least one of a hard disk, an optical disk, a CD-ROM, a CD-R, a memory card, a read only memory (ROM), a random access memory (RAM), and the like. The computer-readable storage medium in the second exemplary embodiment is a non-transitory storage medium.

While the present invention is described with reference to exemplary embodiments, it is to be understood that the present invention is not limited to the exemplary embodiments. The scope of the following claims is to be accorded the broadest interpretation so as to encompass all modifications and equivalent structures.

This application claims the benefit of Japanese Patent Application No. 2013-273493, filed Dec. 27, 2013, which is hereby incorporated by reference herein in its entirety.

What is claimed is:

1. An electronic apparatus comprising:

an antenna unit including an antenna pattern;

a magnetic member that covers at least a part of the antenna unit; and a non-contact type integrated circuit, wherein the antenna unit, the magnetic member, and the integrated circuit are included in a wireless communication device, wherein a ratio of an area of the magnetic member to an area of a region including an outermost periphery of the antenna pattern is 90% or more, wherein the ratio of the area of the magnetic member to the area of the region including the outermost periphery of the antenna pattern is determined such that a deviation between a resonant frequency of the wireless communication device and a target resonant frequency falls within a range of −1.720% to +4.334%, and the range of −1.720% to +4.334% is determined based on a first deviation and a second deviation, and wherein the first deviation is determined based on a decrease in a communication distance between the wireless communication device and another wireless communication device, and the second deviation is determined based on a capacitance tolerance of a capacitor connected between the antenna unit and the integrated circuit.

2. The electronic apparatus according to claim 1, further comprising a member including a concave portion in which the antenna unit, the magnetic member, and the integrated circuit are arranged.

3. The electronic apparatus according to claim 1, further comprising a member including a concave portion in which the antenna unit, the magnetic member, and the integrated circuit are arranged, wherein the member including the concave portion is an outer casing member of the electronic apparatus or a holding member inside the electronic apparatus.

4. The electronic apparatus according to claim 1, further comprising a member including a concave portion in which the antenna unit, the magnetic member, and the integrated circuit are arranged, wherein the concave portion is configured to restrict a relative position of the antenna unit and the magnetic member.

5. The electronic apparatus according to claim 1, further comprising a member including a convex portion in which the antenna unit, the magnetic member, and the integrated circuit are arranged.

6. The electronic apparatus according to claim 1, further comprising a member including a convex portion in which the antenna unit, the magnetic member, and the integrated circuit are arranged, wherein the member including the convex portion is an outer casing member of the electronic apparatus or a holding member inside the electronic apparatus.

7. The electronic apparatus according to claim 1, further comprising a member including a convex portion in which the antenna unit, the magnetic member, and the integrated circuit are arranged, wherein the convex portion is configured to restrict a relative position of the antenna unit and the magnetic member.

8. The electronic apparatus according to claim 1, further comprising:

a substrate on which the antenna unit is arranged; and a member on which the substrate is attached.

9. The electronic apparatus according to claim 1, further comprising:

a substrate on which the antenna unit is arranged; and a member on which the substrate is attached, wherein the member is an outer casing member of the electronic apparatus or a holding member inside the electronic apparatus.

10. The electronic apparatus according to claim 1, further comprising:

a substrate on which the antenna unit is arranged; and a member on which the substrate is attached, wherein the member is configured to restrict a relative position of the antenna unit and the magnetic member.

11. The electronic apparatus according to claim 1, wherein the wireless communication device is a non-contact type integrated circuit device.

12. The electronic apparatus according to claim 1, wherein the antenna pattern has a spiral structure with turns.

13. The electronic apparatus according to claim 1, wherein the wireless communication device is a device that controls wireless communication based on a near field communication (NFC) standard.

14. The electronic apparatus according to claim 1, wherein the integrated circuit is arranged on a substrate on which the antenna unit is arranged.

15. The electronic apparatus according to claim 1, wherein the integrated circuit is arranged on a substrate different from a substrate on which the antenna unit is arranged.

16. The electronic apparatus according to claim 1, wherein the electronic apparatus acts as an image capture apparatus.

17. The electronic apparatus according to claim 1, wherein the electronic apparatus includes a mobile phone.

18. The electronic apparatus according to claim 1, wherein the target resonant frequency is 13.56 MHz.

19. The electronic apparatus according to claim 1, wherein the target resonant frequency is a frequency other than 13.56 MHz.

* * * * *